US007265484B2

(12) United States Patent
Nihei et al.

(10) Patent No.: US 7,265,484 B2
(45) Date of Patent: Sep. 4, 2007

(54) COLOR PICTURE TUBE WITH CURVED SHADOW MASK

(75) Inventors: Fumiaki Nihei, Ibaraki (JP); Norio Shimizu, Ibaraki (JP); Toshio Uchikawa, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 91 days.

(21) Appl. No.: 11/141,380

(22) Filed: May 31, 2005

(65) Prior Publication Data

US 2006/0028115 A1 Feb. 9, 2006

(30) Foreign Application Priority Data

Aug. 5, 2004 (JP) ..... 2004-229674

(51) Int. Cl.
*H01J 29/80* (2006.01)

(52) U.S. Cl. ..... 313/402; 313/408

(58) Field of Classification Search ..... 313/402, 313/406

See application file for complete search history.

(56) References Cited

U.S. PATENT DOCUMENTS

| | | | | |
|---|---|---|---|---|
| 3,731,129 | A | 5/1973 | Tsuneta et al. | |
| 4,677,339 | A | 6/1987 | Inoue et al. | |
| 5,155,410 | A * | 10/1992 | Wakasono et al. | 313/402 |
| 5,416,379 | A * | 5/1995 | Inoue et al. | 313/402 |
| 5,506,466 | A | 4/1996 | Shoda et al. | |
| 5,633,558 | A | 5/1997 | Watanabe et al. | |
| 6,002,203 | A | 12/1999 | Yokota et al. | |
| 6,025,676 | A | 2/2000 | Ohama et al. | |
| 6,335,588 | B1 | 1/2002 | Kim et al. | |
| 6,465,945 | B1 | 10/2002 | Tsuchida et al. | |
| 6,583,546 | B2 | 6/2003 | Nah | |
| 6,650,036 | B2 * | 11/2003 | Nakagawa et al. | 313/402 |
| 6,664,723 | B1 * | 12/2003 | Park et al. | 313/402 |

(Continued)

FOREIGN PATENT DOCUMENTS

| | | |
|---|---|---|
| EP | 0 831 515 | 3/1998 |

(Continued)

*Primary Examiner*—Nimeshkumar D. Patel
*Assistant Examiner*—Peter Macchiarolo
(74) *Attorney, Agent, or Firm*—Hamre, Schumann, Mueller & Larson, P.C.

(57) ABSTRACT

The radius of curvature of an outer surface of a panel useful portion is 10,000 mm or more. Assuming that a length of a perforated region of a shadow mask in an X-axis (major axis) direction is 2L, s is a variable satisfying $0<s<1$, a sagging amount difference of the perforated region at a point of X=sL with respect to a point of X=0 on the X axis and a sagging amount difference of the perforated region at a point of X=L with respect to the point of X=sL on the X axis are $\Delta Z_{01}(s)$ and $\Delta Z_{02}(s)$, respectively, a sagging amount difference of the perforated region at the point of X=sL with respect to the point of X=0 on the long side and a sagging amount difference of the perforated region at the point of X=L with respect to the point of X=sL on the long side are $\Delta Z_{11}(s)$ and $\Delta Z_{12}(s)$, respectively, when $\alpha(s)$ represented by $\alpha(s)=(\Delta Z_{01}(s)/\Delta Z_{11}(s))/(\Delta Z_{02}(s)/\Delta Z_{12}(s))$ is defined, $d\alpha(s)/ds \geqq 0.4$ is satisfied in at least a portion in a range of $0.2 \leqq s \leqq 0.8$. Because of this, a color picture tube can be provided, which has satisfactory visibility, and less degradation in color purity caused by doming while having a shadow mask with excellent formability and strength.

4 Claims, 10 Drawing Sheets

U.S. PATENT DOCUMENTS

| | | | | |
|---|---|---|---|---|
| 6,674,225 | B2 * | 1/2004 | Jung | 313/402 |
| 7,045,942 | B2 * | 5/2006 | Shimizu et al. | 313/402 |
| 2002/0014820 | A1 | 2/2002 | Jung | |
| 2002/0109451 | A1 * | 8/2002 | Nakagawa et al. | 313/402 |
| 2003/0160558 | A1 * | 8/2003 | Ohmae et al. | 313/402 |
| 2004/0000860 | A1 | 1/2004 | Jung | |
| 2004/0164663 | A1 * | 8/2004 | Kim | 313/402 |
| 2006/0066207 | A1 * | 3/2006 | Shimizu et al. | 313/477 R |

FOREIGN PATENT DOCUMENTS

| | | |
|---|---|---|
| EP | 0 926 697 | 6/1999 |
| EP | 0 989 582 | 3/2000 |
| EP | 1 253 617 | 10/2002 |
| EP | 1 258 904 | 11/2002 |
| GB | 1 546 889 | 5/1979 |
| JP | 48-34349 | 10/1973 |
| JP | 51-118956 | 10/1976 |
| JP | 59-165341 | 9/1984 |
| JP | 60-177534 | 9/1985 |
| JP | 6-275206 | 9/1994 |
| JP | 7-161306 | 6/1995 |
| JP | 8-153467 | 6/1996 |
| JP | 9-82236 | 3/1997 |
| JP | 9-320492 | 12/1997 |
| JP | 10-199436 | 7/1998 |
| JP | 2000-113840 | 4/2000 |
| JP | 2000-243317 | 9/2000 |
| JP | 2001-60443 | 3/2001 |
| JP | 2001-351540 | 12/2001 |
| JP | 2002-245948 | 8/2002 |
| JP | 2002-313255 | 10/2002 |
| JP | 2004-31305 | 1/2004 |
| JP | 2004-273133 | 9/2004 |
| WO | 03/105180 | 12/2003 |

* cited by examiner

PRIOR ART $Z(x)=-(a_0+a_1x^2+a_2x^4+a_3x^6)$

| | Major axis | Long side |
|---|---|---|
| a0 | 0.000E+00 | 5.882E+00 |
| a1 | 8.823E-08 | 2.600E-04 |
| a2 | 8.335E-09 | 1.150E-09 |
| a3 | 1.934E-16 | 9.497E-17 |

$Z(x)=-(a_0+a_1x^2+a_2x^4+a_3x^6)$

| | Major axis | Long side |
|---|---|---|
| a0 | 0.000E+00 | 5.010E+00 |
| a1 | 3.079E-04 | 4.499E-04 |
| a2 | -1.323E-09 | -5.472E-09 |
| a3 | 5.227E-14 | 5.633E-14 |

$Z(x)=-(a_0+a_1x^2+a_2x^4+a_3x^6)$

| | Major axis | Long side |
|---|---|---|
| a0 | 0.000E+00 | 3.870E+00 |
| a1 | 8.230E-05 | 2.882E-04 |
| a2 | 1.653E-08 | 1.225E-08 |
| a3 | -2.264E-13 | -1.989E-13 |

$Z(x)=-(a_0+a_1x^2+a_2x^4+a_3x^6)$

| | Major axis | Long side |
|---|---|---|
| a0 | 0.000E+00 | 4.466E+00 |
| a1 | 2.969E-04 | 3.390E-04 |
| a2 | 7.626E-09 | 1.978E-09 |
| a3 | 9.320E-15 | 1.112E-13 |

$Z(x)=-(a_0+a_1x^2+a_2x^4+a_3x^6)$

| | Major axis | Long side |
|---|---|---|
| a0 | 0.000E+00 | 7.493E+00 |
| a1 | 1.672E-05 | 1.464E-04 |
| a2 | 4.039E-09 | 1.488E-09 |
| a3 | -9.228E-15 | -5.517E-15 |

$Z(x)=-(a_0+a_1x^2+a_2x^4+a_3x^6)$

| | Major axis | Long side |
|---|---|---|
| a0 | 0.000E+00 | 5.930E+00 |
| a1 | 5.263E-05 | 1.968E-04 |
| a2 | 4.744E-09 | 1.002E-10 |
| a3 | -2.066E-14 | 5.147E-15 |

COLOR PICTURE TUBE WITH CURVED SHADOW MASK

BACKGROUND OF THE INVENTION

1. Field of the Invention

The present invention relates to a color picture tube. In particular, the present invention relates to a color picture tube in which a radius of curvature of a panel outer surface is 10,000 mm or more.

2. Description of Related Art

In general, as shown in FIG. 3, a color picture tube includes a vacuum envelope 9 composed of a panel 1 having a substantially rectangular useful portion 1*a* and a skirt portion 1*b* connected to the periphery of the useful portion 1*a*, and a funnel 2 in a funnel shape connected to the skirt portion 1*a*. On an inner surface of the useful portion 1*a* of the panel 1, a phosphor screen 3 is formed, which is composed of black non-light-emitting material layers and three-color phosphor layers provided in regions where the black non-light-emitting material layers are not formed. A shadow mask 4 is opposed to the phosphor screen 3. The shadow mask 4 is held on a mask frame 11 in a rectangular frame shape, and the mask frame 11 is attached to an inner wall surface of the panel 1. In a neck 5 of the funnel 2, an electron gun 7 emitting three electron beams 6B, 6G, and 6R is provided. On an inner side of a large diameter portion of the funnel 2, an internal magnetic shield 10 attached to the mask frame 11 is placed. A deflection apparatus 8 is provided on an outer side of the funnel 2. The three electron beams 6B, 6G, and 6R emitted from the electron gun 7 are deflected by a magnetic field generated by the deflection apparatus 8, and pass through electron beam passage apertures formed in the shadow mask 4 to scan the phosphor screen 3 in horizontal and vertical directions, whereby a color image is displayed.

In such a color picture tube, in order to display an image without color displacement on the phosphor screen 3, it is necessary that the three electron beams 6B, 6G, and 6R having passed through the electron beam passage apertures formed in the shadow mask 4 should land correctly on the three-color phosphor layers. For this purpose, the relationship of the shadow mask 4 with respect to the panel 1 is important. Above all, it is necessary that an interval (q value) between the inner surface of the useful portion 1*a* of the panel 1 and a region (perforated region) of the shadow mask 4 in which the electron beam passage apertures are formed is within a predetermined allowable range.

Of all the electron beams emitted from the electron gun 7, only a part thereof reaches the phosphor screen 3. The remaining electron beams strike the shadow mask 4. At this time, the kinetic energy of the electron beams changes to thermal energy to heat the shadow mask 4. Therefore, the shadow mask expands thermally in accordance with the coefficient of thermal expansion of the material thereof, and its shape changes. Consequently, the positions of the electron beam passage apertures with respect to phosphors change, and when the change amount of these positions exceeds an allowable value, the electron beams cannot strike desired phosphors so that so-called mislanding occurs, which degrades the color purity of a display image.

In the thermal expansion of the shadow mask 4 caused by the irradiation with electron beams, in the case where only a part of the perforated region is irradiated with a large amount of electron beams, the change amount of the positions of the electron beam passage apertures with respect to the phosphors becomes particularly large, and the color purity is degraded significantly due to the mislanding of the electron beams. For example, as shown in FIG. 4, the following is known generally. In the case where only band-shaped regions 20 each extending in a minor axis (Y-axis) direction, positioned substantially at an intermediate portion between a screen center and a major axis (X-axis) end of a screen, are set to be a white display, and a region 21 other than the band-shaped regions 20 is set to be a black display, the color purity is most likely to be degraded. In the case of performing such a display, the perforated region of the shadow mask 4 deforms thermally as shown in FIG. 5. More specifically, the temperature of portions corresponding to the band-shaped regions 20, in which a white display is performed, in the perforated region increases locally, and these portions deform so as to protrude to a phosphor screen side (doming). When such local doming occurs, on the major axis where the movement amount in a tube axis direction of the surface of the perforated region becomes large, the color purity is degraded most significantly.

Recently, in order to enhance the visibility of a color picture tube, there is a demand that the radius of curvature of the outer surface of the useful portion 1*a* of the panel 1 is increased so as to bring the outer surface close to a flat surface. In this case, in terms of the strength of the vacuum envelope 9 with respect to the atmospheric pressure and visibility, it is necessary to increase the radius of curvature of the inner surface of the useful portion 1*a*. In order to obtain appropriate electron beam landing in accordance with the increase in the radius of curvature of the inner surface of the useful portion 1*a*, it is necessary to increase the radius of curvature of the perforated region of the shadow mask 4. However, when the radius of curvature of the perforated region of the shadow mask 4 is increased, the change amount of the positions of the electron beam passage apertures with respect to the phosphors due to doming increases, and the mislanding amount of the electron beams increases, so that the color purity is degraded significantly.

Therefore, in a color picture tube having the panel 1 with a substantially flat outer surface, in order to suppress doming, in most cases, an alloy mainly containing iron and nickel, having a low coefficient of thermal expansion, is used as a material for the shadow mask 4. For example, a 36 Ni Invar alloy or the like is used frequently. In this case, the iron-nickel alloy entails high cost, while providing a coefficient of thermal expansion of 1 to $2\times10^{-6}$ at 0° C. to 100° C., which is effective for suppressing doming. Furthermore, the iron-nickel alloy has large elasticity after annealing, so that it is difficult to form a curved surface from such an alloy by press forming and to obtain a desired curved surface. Even if the iron-nickel alloy is annealed, for example, at a high temperature of 900° C., the yield point strength is about $28\times10^7$ N/m$^2$. Thus, it is necessary to treat the alloy at a considerably high temperature in order to set the yield point strength to be $20\times10^7$ N/m$^2$ or less at which press forming generally is considered to be easy. Particularly, in a color picture tube with a flat panel outer surface, the radius of curvature of the perforated region of the shadow mask is large, so that press forming is further difficult.

In the case where press forming is insufficient, and undesired stress remains in the shadow mask 4 after press forming, the residual stress changes the shape of the shadow mask 4 in the course of production of the color picture tube, which leads to the mislanding of the electron beams, resulting in significant degradation in the color purity.

On the other hand, with aluminum killed steel mainly containing high-purity iron, the yield point strength can be set to be $20\times10^7$ N/m$^2$ or less by annealing at about 800° C., so that press forming is very easy. Thus, regarding the aluminum killed steel, it is not necessary to keep the press die temperature to be high in the course of press forming, which is required in an Invar alloy, and the productivity also is satisfactory.

However, the coefficient of thermal expansion of the aluminum killed steel is high (i.e., about $12\times10^{-6}$ at 0° C. to 100° C.), which is disadvantageous for doming. Particularly, in the case of applying the aluminum killed steel to a color picture tube in which the outer surface of the useful portion 1*a* of the panel 1 is substantially flat, there arises a serious problem such as the significant degradation in color purity.

JP 10(1998)-199436 A discloses a shadow mask in the shape of a substantially cylindrical surface, in which the radius of curvature in a major axis direction is almost infinite, and the radius of curvature in a minor axis direction is almost constant irrespective of the position in the major axis direction. Even such a shadow mask has an effect of suppressing doming to some degree. However, in the case of using an inexpensive iron material, a sufficient effect cannot be obtained. Furthermore, there is a problem that the weight of a panel increases.

As described above, in the color picture tube, when the radius of curvature of the outer surface of the useful portion of the panel is increased so as to enhance visibility, and the radius of curvature of the perforated region of the shadow mask is increased in accordance with the increase in the radius of curvature of the outer surface of the useful portion, the mislanding amount of the electron beams increases due to the thermal expansion of the shadow mask, and consequently, the color purity is degraded significantly.

Furthermore, in the case of using an iron material that is inexpensive and has satisfactory formability as a material for the shadow mask, the mislanding amount of the electron beams caused by the thermal expansion of the shadow mask further increases due to its large coefficient of thermal expansion, and consequently, the color purity is degraded significantly.

SUMMARY OF THE INVENTION

The present invention has been achieved in view of the above-mentioned problems, and its object is to provide a color picture tube that has satisfactory visibility, and less degradation in color purity caused by doming while having a shadow mask with excellent formability and strength.

A color picture tube of the present invention includes a panel in which a phosphor screen is formed on an inner surface of a substantially rectangular useful portion, and a shadow mask.

The shadow mask includes a perforated region opposed to the phosphor screen and made of a substantially rectangular curved surface in which a number of electron beam passage apertures are formed, a non-perforated region placed on a periphery of the perforated region so as to surround the perforated region, and a skirt portion connected to the non-perforated region and bent with respect to the non-perforated region, A radius of curvature of an outer surface of the useful portion of the panel is 10,000 mm or more.

It is assumed that a tube axis direction axis is a Z-axis, an axis orthogonal to the Z-axis and parallel to a long side (long edge) direction of the perforated region is an X-axis, an axis orthogonal to the Z-axis and parallel to a short side (short edge) direction of the perforated region is a Y-axis, a size of the perforated region on the X-axis is 2L, and s is a variable satisfying $0<s<1$. It is assumed that sagging amounts in a Z-axis direction of a surface of the perforated region with respect to a mask center at respective points of X=0, sL, L on the X-axis are $Z_{00}$, $Z_{01}(s)$, $Z_{02}$, and sagging amounts in the Z-axis direction of the surface of the perforated region with respect to the mask center at respective points of X=0, sL, L on the long side of the perforated region are $Z_{10}$, $Z_{11}(s)$, $Z_{12}$.

When, using a sagging amount difference $\Delta Z_{01}(s)$ at the point of X=sL with respect to the point of X=0 on the X-axis, defined by $\Delta Z_{01}(s)=Z_{01}(s)-Z_{00}$, a sagging amount difference $\Delta Z_{02}(s)$ at the point of X=L with respect to the point of X=sL on the X-axis, defined by $\Delta Z_{02}(s)=Z_{02}-Z_{01}(s)$ a sagging amount difference $\Delta Z_{11}(s)$ at the point of X=sL with respect to the point of X=0 on the long side, defined by $\Delta Z_{11}(s)=Z_{11}(s)-Z_{10}$, and a sagging amount difference $\Delta Z_{12}(s)$ at the point of X=L with respect to the point of X=sL on the long side, defined by $\Delta Z_{12}(s)=Z_{12}-Z_{11}(s)$, $\alpha(s)$ represented by $\alpha(s)=(\Delta Z_{01}(s)/\Delta Z_{11}(s))/(\Delta Z_{02}(s)/\Delta Z_{12}(s))$ is defined, $d\alpha(s)/ds\geqq0.4$ is satisfied in at least a part in a range of $0.2\leqq s\leqq0.8$.

DETAILED DESCRIPTION OF THE PREFERRED EMBODIMENTS

According to the present invention, a color picture tube can be provided, which has satisfactory visibility, and less degradation in color purity caused by doming while having a shadow mask with excellent formability and strength.

Hereinafter, the color picture tube of the present invention will be described with reference to the drawings.

Figure 3:
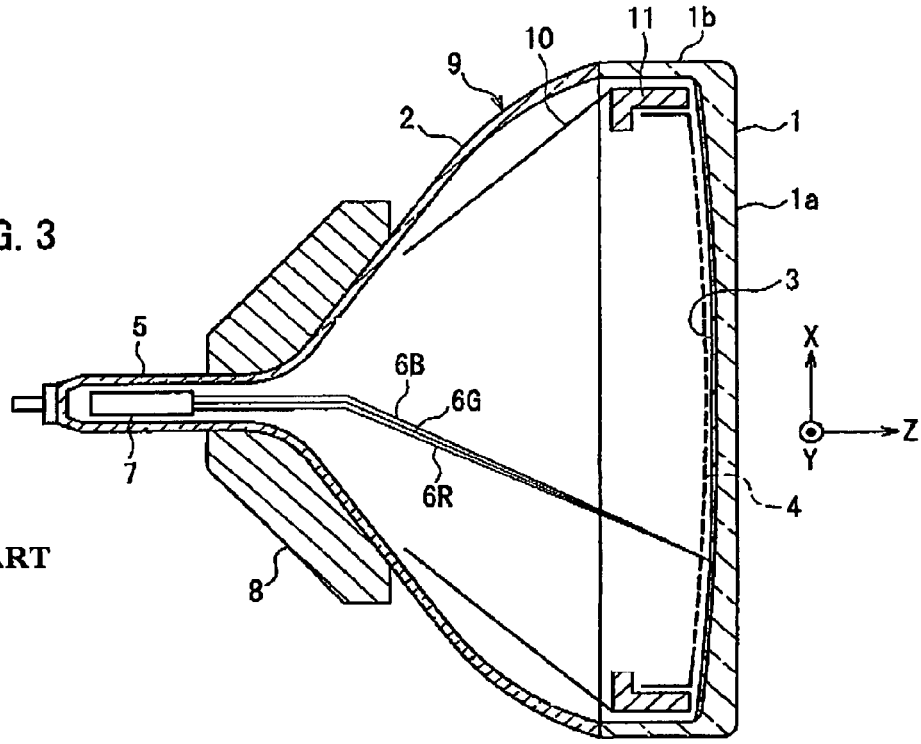
FIG. 3 is a cross-sectional view showing an exemplary schematic configuration of the color picture tube.

The schematic configuration of the color picture tube according to the present invention is the same as that of the conventional color picture tube shown in FIG. 3 except for the shape of a shadow mask.

Figure 6:
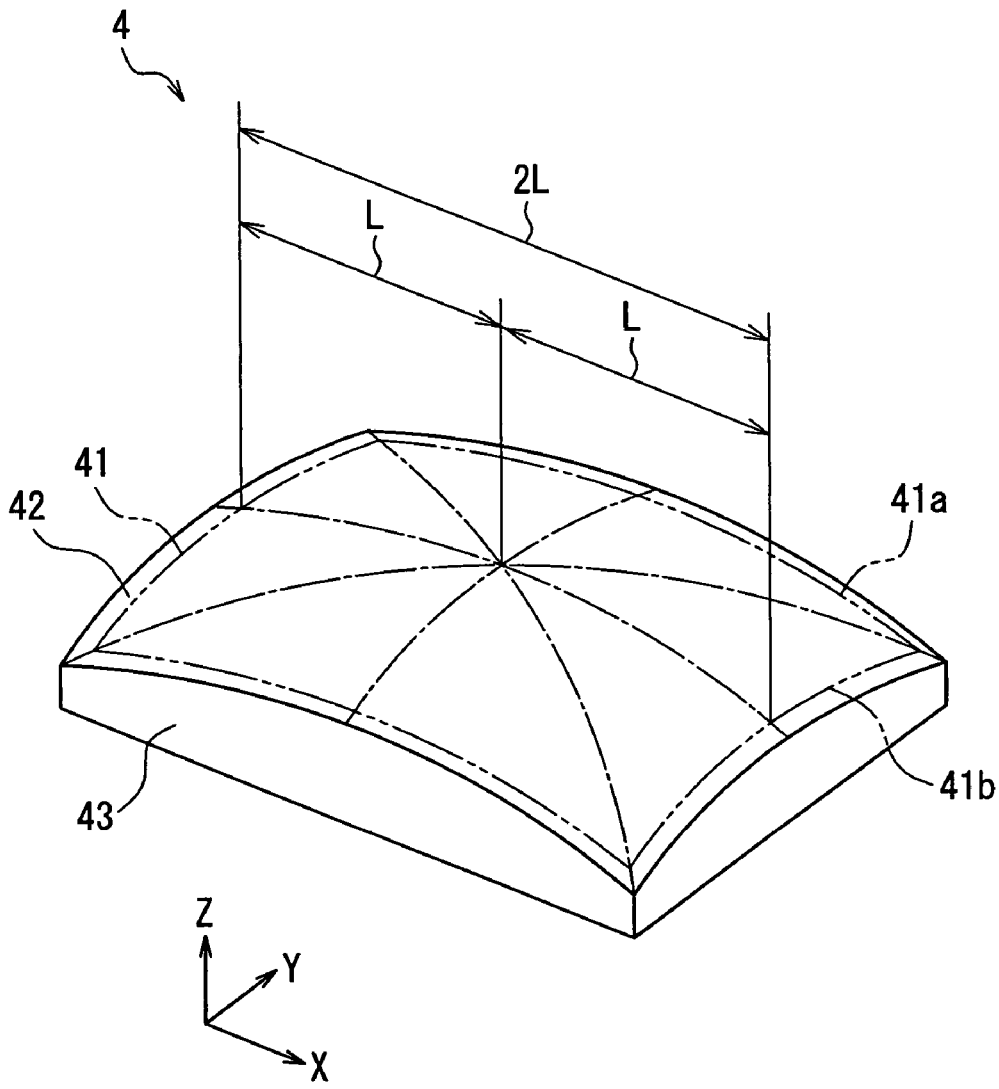
FIG. 6 is a perspective view of one embodiment of a shadow mask to be mounted on a color picture tube according to the present invention.

FIG. 6 is a perspective view of one embodiment of a shadow mask 4 to be mounted on the color picture tube according to the present invention. The shadow mask 4 includes a perforated region 41 opposed to the phosphor screen 3 and made of a substantially rectangular curved surface in which a number of electron beam passage apertures (not shown) are formed, a non-perforated region 42 placed on the periphery of the perforated region 41 so as to surround it, and a skirt portion 43 connected to the non-perforated region 42 and bent with respect to the non-perforated region 42. The skirt portion 43 is fitted inside the mask frame 1, and they are welded together, whereby the shadow mask 4 is integrated with the mask frame 11. The shadow mask 4 is produced by subjecting a metal flat plate, in which electron beam passage apertures are formed by etching, to press forming.

The outer surface of the useful portion 1*a* of the panel 1 forming the color picture tube of the present invention is a substantially flat surface with a radius of curvature of 10,000 mm or more so as to enhance visibility. Thus, in terms of the strength of the envelope 9 with respect to the atmospheric pressure and visibility, it is necessary to increase the radius of curvature of the inner surface of the useful portion 1*a*. In order to obtain appropriate electron beam landing in accordance with the increase in the radius of curvature of the inner surface of the useful portion 1*a*, it is necessary to increase the radius of curvature of the perforated region 41 of the shadow mask 4. In general, when the radius of curvature of the perforated region 41 of the shadow mask 4 is increased, it becomes difficult to press-form the perforated region 41 to a curved surface. According to the present invention, it is preferable to use a material containing 95% or more of iron as a material for the shadow mask 4. This can remarkably improve the formability of a curved surface at low cost.

Figure 4:
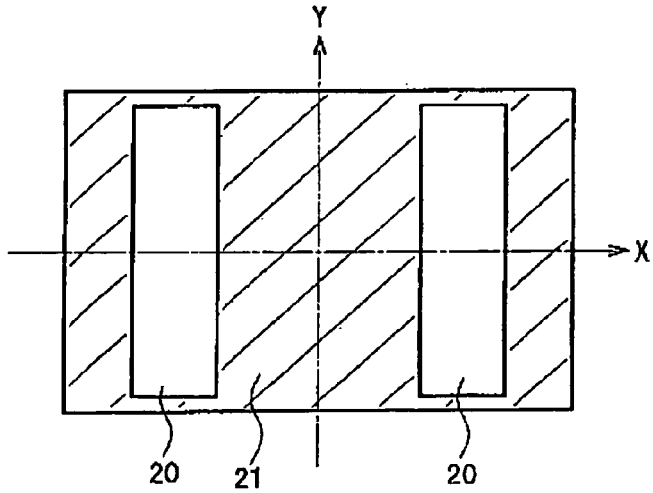
PRIOR ART FIG. 4
FIG. 4 shows a display pattern in which the color purity is degraded most significantly.

However, such a material has a high coefficient of thermal expansion. Therefore, when an image pattern with locally high brightness is displayed as shown in FIG. 4, local doming occurs, and the local mislanding amount of electron beams becomes large in a short period of time. As measures for addressing the above-mentioned problem, increasing the curvature of the perforated region 41 of the shadow mask 4, and also maximizing the curvature of the inner surface of the useful portion 1*a* of the panel 1 in accordance with the increase in the curvature of the perforated region 41 can be considered. However, in this case, owing to the increase in thickness of the periphery of the panel 1, there arise problems such as the cracking of the panel 1 caused by thermal stress in the course of production, the degradation in brightness on the periphery of the screen, and the increase in weight.

The present invention solves the above-mentioned problems. One example thereof will be described below by exemplifying a color picture tube with a diagonal size of 51 cm, an aspect ratio of 4:3, and a radius of curvature of the outer surface of the useful portion 1a of the panel 1 of 20,000 mm (hereinafter, referred to as "Example 1").

The outer surface of the panel 1 of the color picture tube of Example 1 is flattened sufficiently as described above, and the shadow mask 4 is made of aluminum killed steel shown in Table 1 made of high-purity iron with a coefficient of thermal expansion of $12\times10^{-6}$ at 0° C. to 100° C. Therefore, the sufficient formability is ensured while providing low cost.

TABLE 1

| Component | Aluminum killed steel | Invar alloy |
|---|---|---|
| C | 0.002 | 0.009 |
| Mn | 0.3 | 0.47 |
| Si | <0.01 | 0.13 |
| P | 0.016 | 0.005 |
| S | 0.009 | 0.002 |
| Al | 0.052 | — |
| Ni(+Co) | — | 36.5 |
| Fe | Remaining portion | Remaining portion |

(Unit: %)

As shown in FIGS. 3 and 6, it is assumed that a tube axis direction axis of the color picture tube is a Z-axis, an axis orthogonal to the Z-axis and parallel to a direction of a long side 41*a* of the perforated region 41 is an X-axis, and an axis orthogonal to the Z-axis and parallel to a direction of a short side 41*b* of the perforated region 41 is a Y-axis. Furthermore, it is assumed that a size of the perforated region 41 on the X-axis is 2L.

Figure 1:
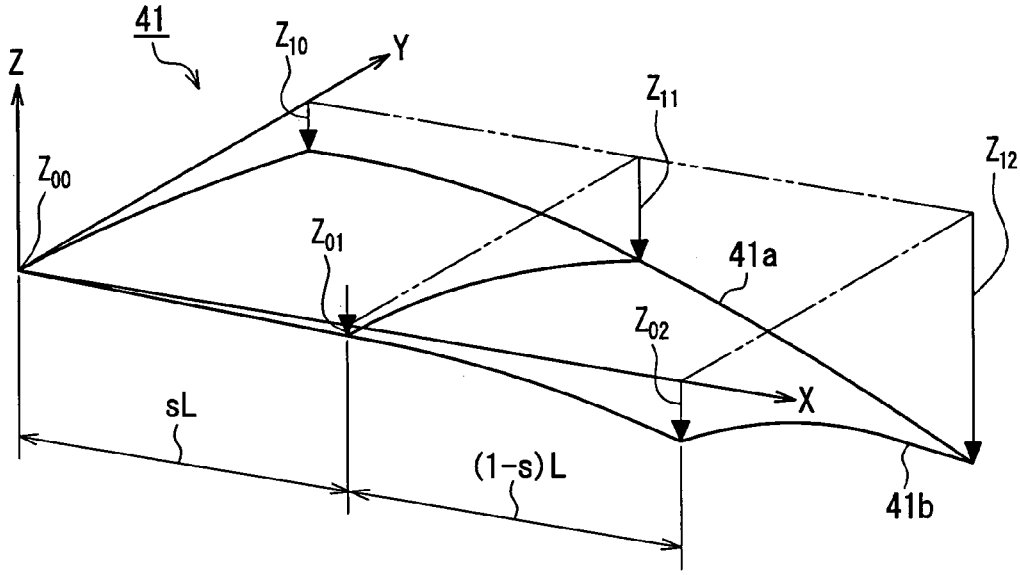
FIG. 1 is a perspective view showing a definition of a sagging amount of a perforated region of a shadow mask of a color picture tube according to one embodiment of the present invention.

FIG. 1 is a perspective view showing a ¼ quadrant of the perforated region 41 of the shadow mask 4. In the present invention, the shape of the surface of the perforated region 41 is expressed with a sagging amount. The sagging amount refers to a displacement amount in the Z-axis direction at a point in the perforated region 41, based on a point (mask center) on the surface of the shadow mask 4 that the Z-axis crosses.

It is assumed that s is a variable satisfying $0<s<1$, and as shown in the figure, sagging amounts in the Z-axis direction of the surface of the perforated region 41 with respect to the mask center at respective points (X=0, sL, L) on the X-axis are $Z_{00}$, $Z_{01}(s)$, and $Z_{02}$. Furthermore, it is assumed that sagging amounts in the Z-axis direction of the surface of the perforated region 41 with respect to the mask center at respective points (X=0, sL, L) on the long side 41*a* of the perforated region 41 are $Z_{10}$, $Z_{11}(s)$, and $Z_{12}$.

Figure 2:
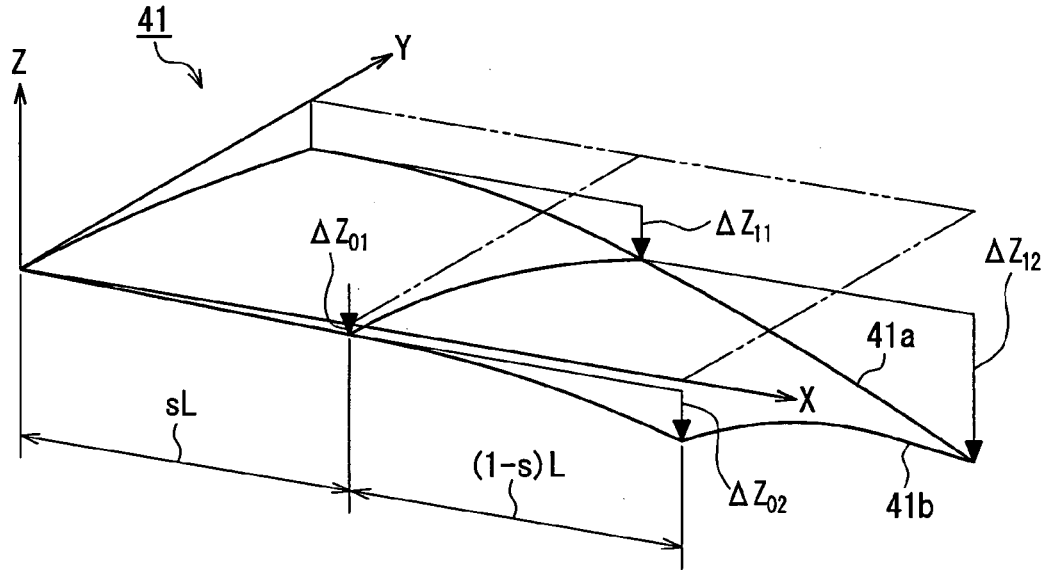
FIG. 2 is a perspective view showing a definition of a sagging amount difference of the perforated region of the shadow mask of the color cathode-ray tube according to one embodiment of the present invention.

Furthermore, a sagging amount difference that is the difference in sagging amounts among these respective points is defined as shown in FIG. 2. That is, a sagging amount difference $\Delta Z_{01}(s)$ is a sagging amount difference at the point of X=sL with respect to the point of X=0 on the X-axis, and is defined by $\Delta Z_{01}(s)=Z_{01}(x)-Z_{00}$. A sagging amount difference $\Delta Z_{02}(s)$ is a sagging amount difference at the point of X=L with respect to the point of X=sL on the X-axis, and is defined by $\Delta Z_{02}(s)=Z_{02}-Z_{01}(s)$. A sagging amount difference $\Delta Z_{11}(s)$ is a sagging amount difference at the point of X=sL with respect to the point of X=0 on the long side, and is defined by $\Delta Z_{11}(s)=Z_{11}(s)-Z_{10}$. A sagging amount difference $\Delta Z_{12}(s)$ is a sagging amount difference at the point of X=L with respect to the point of X=sL on the long side, and is defined by $\Delta Z_{12}(s)=Z_{12}-Z_{11}(s)$. Furthermore, using these sagging amount differences, α(s) represented by the following expression:

$$\alpha(s)=(\Delta Z_{01}(s)/\Delta Z_{11}(s))/(\Delta Z_{02}(s)/\Delta Z_{12}(s))$$

is defined.

Figure 7:
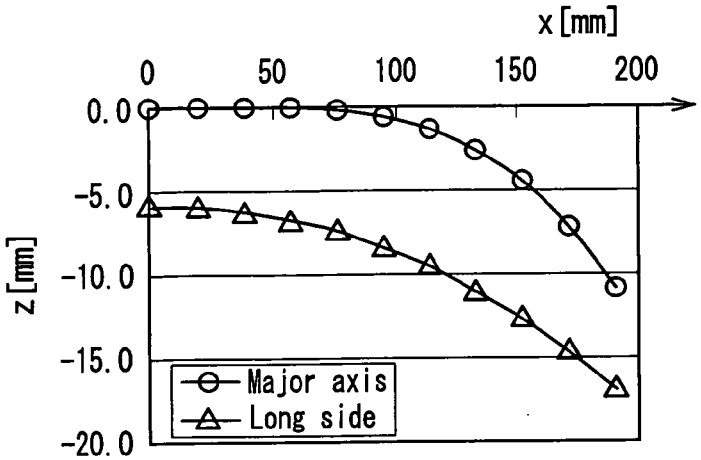
FIG. 7 shows sagging amounts along an X-axis and a long side of a perforated region of a shadow mask according to Example 1 of the present invention.
Figure 8:
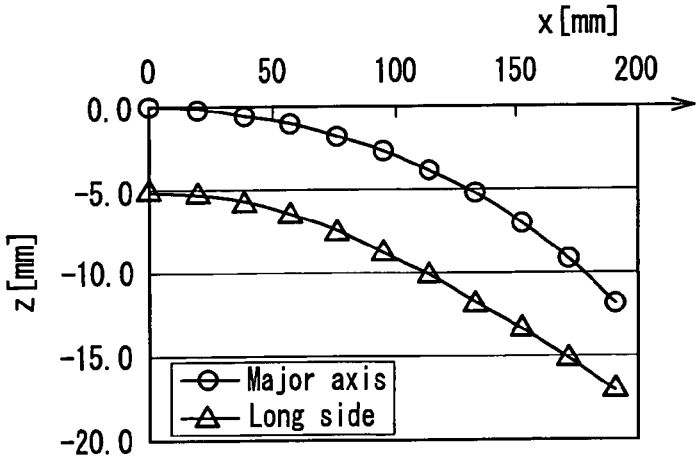
FIG. 8 shows sagging amounts along an X-axis and a long side of a perforated region of a shadow mask according to Comparative Example 1.

FIG. 7 shows sagging amounts along the X-axis and the long side 41*a* of the perforated region 41 of the shadow mask of the color picture tube according to Example 1. Furthermore, FIG. 8 shows sagging amounts along the X-axis and the long side 41*a* of the perforated region 41 of the shadow mask 4 according to Comparative Example 1. The color picture tube according to Comparative Example 1 is different from that of Example 1 only in the shape of the shadow mask 4. The sagging amounts along the X-axis and the long side 41*a* of the perforated region 41 can be approximated by a sixth degree polynomial of an X-coordinate value x, and coefficients of respective terms are as shown in bottom columns in FIGS. 7 and 8. In Example 1 and Comparative Example 1, in order to match the flatness of the shadow mask to facilitate the comparison, a sagging amount $Z_{12}$ at a diagonal axis end (x=190 mm, y=143 mm) is set to be the same ($Z_{12}$=16.77 mm). The material for the shadow mask of Comparative Example 1 is the same as that of Example 1, and the curved surface shape of the perforated region 41 of the shadow mask in Comparative Example 1 is set to be the same as that of a curved surface in which the doming amount can be suppressed within an allowable range while satisfactory visibility is obtained, in the case where a material (e.g., an Invar alloy in Table 1) with a low coefficient of thermal expansion is used.

Figure 9:
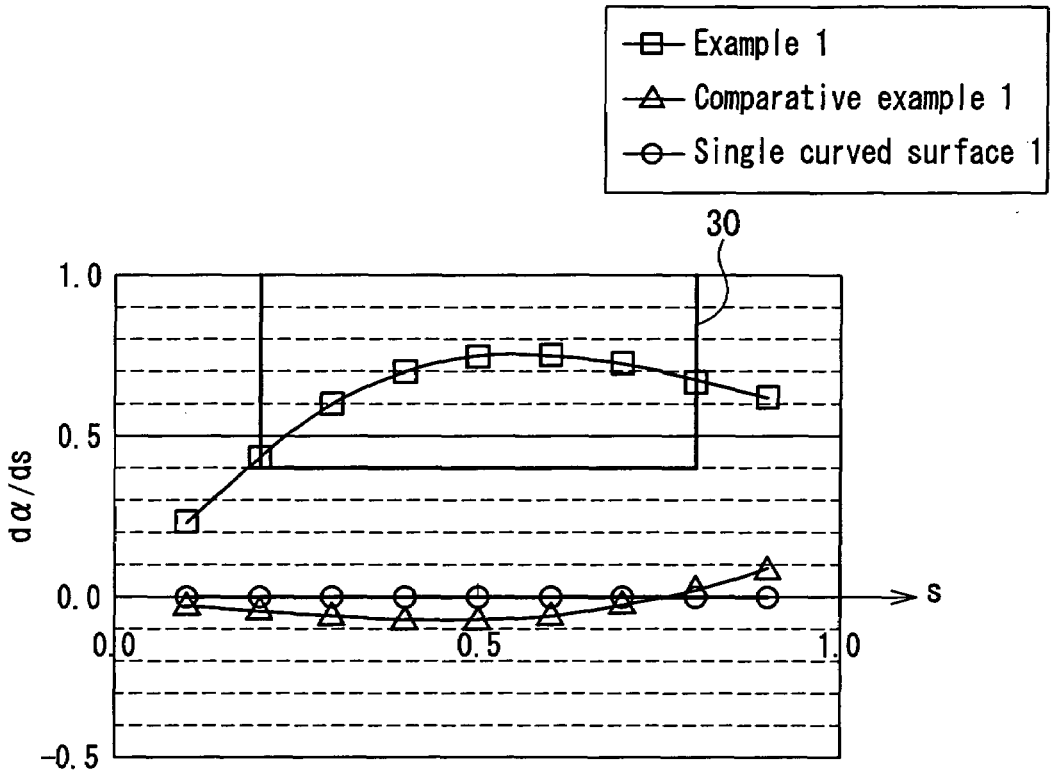
FIG. 9 shows change curves of $d\alpha(s)/ds$ regarding a shadow mask with a diagonal size of 51 cm.

The sagging amount at each point is determined by a position x (i.e., s) in the X-axis direction. FIG. 9 shows change curves of a primary differential dα(s)/ds of the above α(s) with respect to s in Example 1 and Comparative Example 1. In FIG. 9, a "single curved surface 1" refers to a shadow mask having a perforated region in a spherical shape with a radius of curvature of 1694 mm in which the sagging amount $Z_{12}$ at the diagonal axis end is set to be the same as those of Example 1 and Comparative Example 1.

FIG. 9 shows a range satisfying $0.2 \leqq s \leqq 0.8$ and $d\alpha(s)/ds \geqq 0.4$ as a region 30. In Example 1 according to the present invention, $d\alpha(s)/ds \geqq 0.4$ is satisfied in the entire range of $0.2 \leqq s \leqq 0.8$. More specifically, in the entire range of $0.2<s<0.8$, the change curve of dα(s)/ds passes through the region 30. Furthermore, a maximum value of dα(s)/ds is present in the range of $0.2 \leqq s \leqq 0.8$. In contrast, in Comparative Example 1, $|d\alpha(s)/ds| \leqq 0.2$ is satisfied in the range of $0.2 \leqq s \leqq 0.8$, and in the single curved surface 1, $d\alpha(s)/ds=0$ is satisfied over the entire surface of the perforated region 41 irrespective of the value of s. Thus, the change curve of dα(s)/ds does not pass through the region 30 in Comparative Example 1 and the single curved surface 1.

Figure 5:
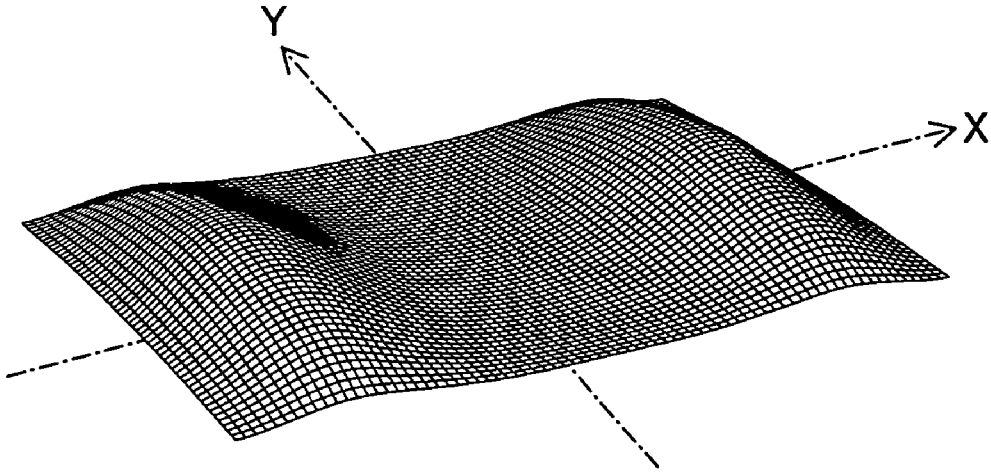
FIG. 5 is a perspective view showing a thermally deformed state of the perforated region of the shadow mask in the case of performing a display as shown in FIG. 4.

In the shadow mask in Example 1, the sagging amount $Z_{12}$ at the diagonal axis end is the same as that of Comparative Example 1. Therefore, when the shadow mask in Example 1 is applied to a panel having a flat outer surface, a color picture tube having excellent visibility can be realized. Furthermore, the shadow mask is made of a material containing 95% or more of iron, so that the formability of the shadow mask is satisfactory and the cost thereof is low. Furthermore, since the sagging amount difference in a range of X=0.5 L to X=L is large, on the periphery of a point of X=0.5 L at which local doming as described with reference to FIG. 5 is likely to occur, the reduction in the radius of curvature in the Y-axis direction, which is considered to have a large effect of suppressing the mislanding amount of electron beams, can be realized.

Table 2 shows the movement amount of electron beams due to doming at an intermediate position (intermediate position on the major axis) between the screen center and the X-axis end of the screen, when the display as shown in FIG. 4 is performed, in the respective color picture tubes having the shadow masks of Example 1, Comparative Example 1, and the single curved surface 1. In an image display, a high voltage side potential was 29 kV, a cathode current was 1300 μA, and a width of a white band-shaped region 20 was 75 mm. In Table 2, a "diagonal axis average radius of curvature" refers to an apparent radius of curvature of a shadow mask on a surface including the Z-axis and the diagonal axis, obtained from the respective sagging amounts $Z_{00}$ and $Z_{12}$ at the center and diagonal axis end of the shadow mask. The values of the diagonal axis average radius of curvature of Example 1, Comparative Example 1, and the single curved surface 1 being the same indicates that the sagging amounts $Z_{12}$ at these diagonal axis ends are the same.

TABLE 2

| Diagonal size | | Movement amount of electron beams | | Diagonal axis average radius of curvature |
|---|---|---|---|---|
| 51 cm | Single curved surface 1 | 443 μm | | 1694 mm |
| | Comparative Example 1 | 439 μm | (99%) | |
| | Example 1 | 255 μm | (58%) | |
| 36 cm | Single curved surface 2 | 310 μm | — | 1207 mm |
| | Comparative Example 2 | 300 μm | (97%) | |
| | Example 2 | 243 μm | (78%) | |
| 60 cm | Single curved surface 3 | 578 μm | — | 2209 mm |
| | Example 3 | 330 μm | (57%) | |
| | Example 4 | 506 μm | (88%) | 2362 mm |

As is understood from Table 2, the movement amount of electron beams is 400 μm or more in the single curved surface 1 and Comparative Example 1, while the movement amount of electron beams is less than 300 μm in Example 1. Thus, in Example 1, the movement amount of electron beams is reduced to 58% of that of the single curved surface 1.

An example of applying the present invention to another size will be described. As a second application example, a color picture tube with a diagonal size of 36 cm, and an aspect ratio of 4:3 will be described.

Figure 10:
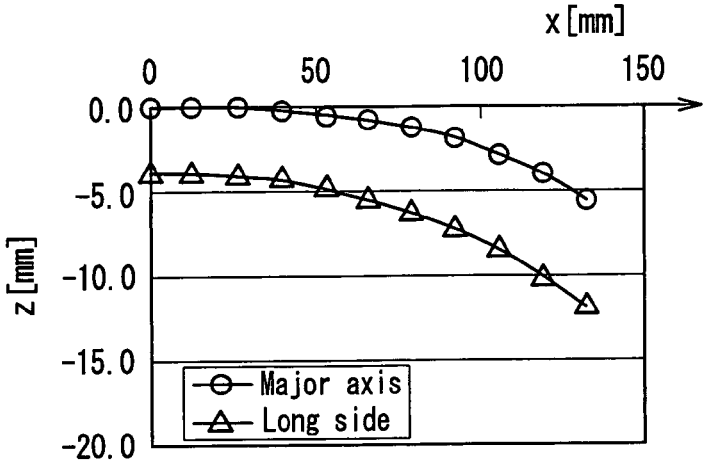
FIG. 10 shows sagging amounts along an X-axis and a long side of a perforated region of a shadow mask according to Example 2 of the present invention.

FIG. 10 shows sagging amounts along the X-axis and the long side 41*a* of the perforated region 41 of the shadow mask of the color picture tube according to Example 2. The configuration of the color picture tube of Example 2 is substantially the same as that of Example 1, except for the difference in a size. The outer surface of the panel 1 of the color picture tube of Example 2 has a radius of curvature of 10,000 mm or more, and hence is flattened sufficiently. The shadow mask 4 is made of aluminum killed steel shown in Table 1 made of high-purity iron with a coefficient of thermal expansion of $12\times10^{-6}$ at 0° C. to 100° C.

Figure 11:
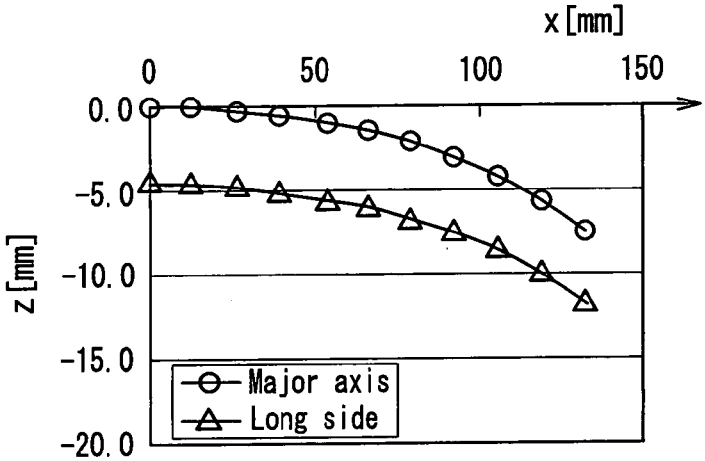
FIG. 11 shows sagging amounts along an X-axis and a long side of a perforated region of a shadow mask according to Comparative Example 2.

FIG. 11 shows sagging amounts along the X-axis and the long side 41*a* of the perforated region 41 of the shadow mask 4 according to Comparative Example 2. The color picture tube according to Comparative Example 2 is different from that of Example 2 only in the shape of the shadow mask 4.

The sagging amounts along the X-axis and the long side 41*a* of the perforated region 41 can be approximated by a sixth degree polynomial of an X-coordinate value x, and coefficients of respective terms are as shown in bottom columns in FIGS. 10 and 11. In Example 2 and Comparative Example 2, in order to match the flatness of the shadow mask to facilitate the comparison, a sagging amount $Z_{12}$ at a diagonal axis end (x=133 mm, y=102 mm) is set to be the same ($Z_{12}$=11.7 mm). The material for the shadow mask of Comparative Example 2 is the same as that of Example 2, and the curved surface shape of the perforated region 41 of the shadow mask in Comparative Example 2 is set to be the same shape as that of a curved surface in which the doming amount can be suppressed within an allowable range while satisfactory visibility is obtained, in the case where a material (e.g., an Invar alloy in Table 1) with a low coefficient of thermal expansion is used.

Figure 12:
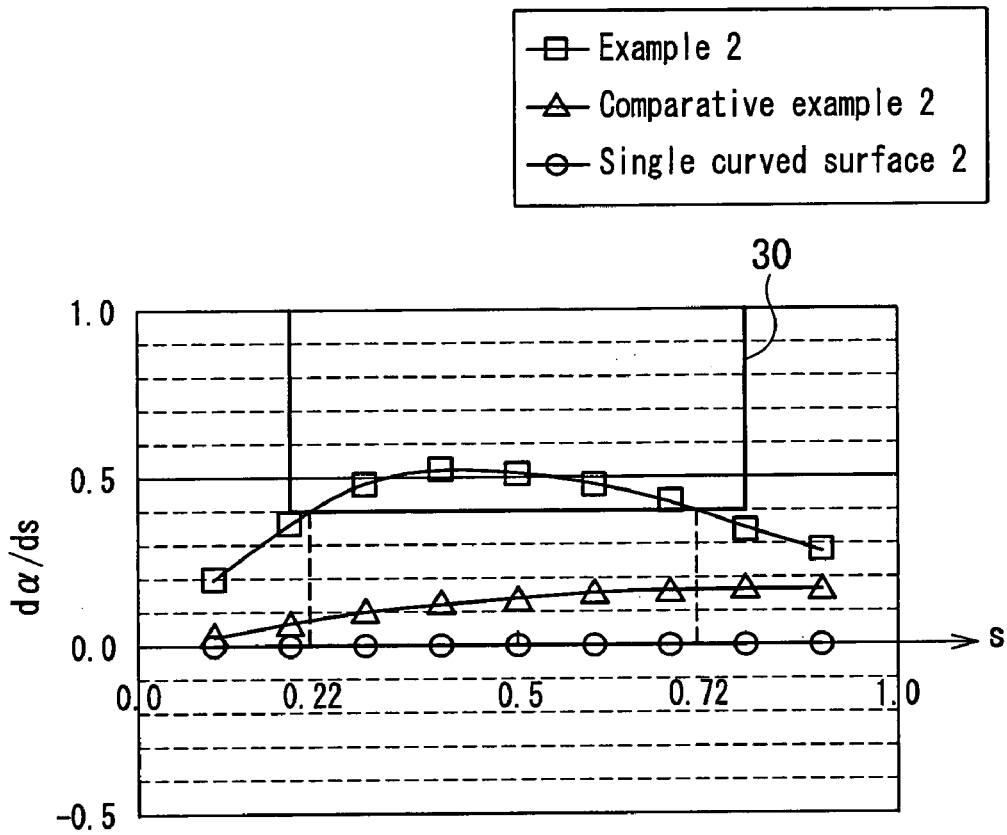
FIG. 12 shows change curves of $d\alpha(s)/ds$ regarding a shadow mask with a diagonal size of 36 cm.

FIG. 12 shows change curves of $d\alpha(s)/ds$ with respect to s in Example 2, Comparative Example 2, and a single curved surface 2 in the same way as in FIG. 9. The "single curved surface 2" refers to a shadow mask having a perforated region in a spherical shape with a radius of curvature of 1207 mm in which the sagging amount $Z_{12}$ at the diagonal axis end is set to be the same as those of Example 2 and Comparative Example 2.

In Example 2 according to the present invention, $d\alpha(s)/ds \geqq 0.4$ is satisfied in a range of $0.22 \leqq s \leqq 0.72$. More specifically, in a portion of 83% (=[(0.72−0.22)/(0.8−0.2)]×100) in the range of $0.2 \leqq s \leqq 0.8$, the change curve of $d\alpha(s)/ds$ passes through the region 30. Furthermore, a maximum value of $d\alpha(s)/ds$ is present in the range of $0.2 \leqq s \leqq 0.8$. In contrast, in Comparative Example 2, $|d\alpha(s)/ds| \leqq 0.2$ is satisfied in the range of $0.2 \leqq s \leqq 0.8$, and in the single curved surface 2, $d\alpha(s)/ds=0$ is satisfied over the entire surface of the perforated region 41 irrespective of the value of s. Thus, the change curve of $d\alpha(s)/ds$ does not pass through the region 30 in Comparative Example 2 and the single curved surface 2.

In the shadow mask in Example 2, the sagging amount $Z_{12}$ at the diagonal axis end is the same as that of Comparative Example 2. Therefore, when the shadow mask in Example 2 is applied to a panel having a flat outer surface, a color picture tube having excellent visibility can be realized. Furthermore, the shadow mask is made of a material containing 95% or more of iron, so that the formability of the shadow mask is satisfactory and the cost thereof is low.

Table 2 shows the movement amount of electron beams due to doming at an intermediate position (intermediate position on the major axis) between the screen center and the X-axis end of the screen, when the display as shown in FIG. 4 is performed, in the respective color picture tubes having the shadow masks of Example 2, Comparative Example 2, and the single curved surface 2.

As is understood from Table 2, the movement amount of electron beams is 300 μm or more in the single curved surface 2 and Comparative Example 2, while the movement amount of electron beams is 243 μm in Example 2. Thus, in Example 2, the movement amount of electron beams is reduced to 78% of that of the single curved surface 2. If at least a part of the change curve of $d\alpha(s)/ds$ passes through the region 30, the mislanding amount of electron beams due to doming can be reduced. Furthermore, as in Example 2, if the change curve of $d\alpha(s)/ds$ passes through the region 30 in a portion of 50% or more in the range of $0.2 \leqq s \leqq 0.8$, the mislanding amount of electron beams due to doming can be reduced further.

An example of applying the present invention to still another size will be described. As a third application example, a color picture tube with a diagonal size of 60 cm, and an aspect ratio of 4:3 will be described.

Figure 13:
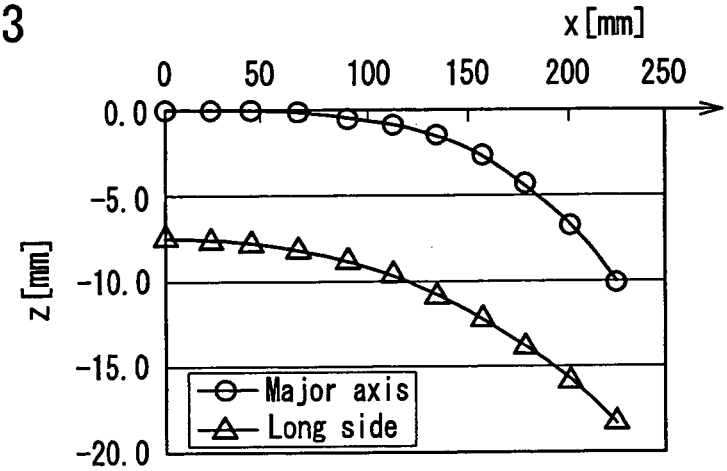
FIG. 13 shows sagging amounts along an X-axis and a long side of a perforated region of a shadow mask according to Example 3 of the present invention.

FIG. 13 shows sagging amounts along the X-axis and the long side 41*a* of the perforated region 41 of the shadow mask of the color picture tube according to Example 3. The configuration of the color picture tube of Example 3 is substantially the same as that of Example 1, except for the difference in a size. The outer surface of the panel 1 of the color picture tube of Example 3 has a radius of curvature of 10,000 mm or more, and hence is flattened sufficiently. The shadow mask 4 is made of aluminum killed steel shown in Table 1 made of high-purity iron with a coefficient of thermal expansion of $12\times10^{-6}$ at 0° C. to 100° C. The sagging amounts along the X-axis and the long side 41*a* of the perforated region 41 can be approximated by a sixth degree polynomial of an X-coordinate value x, and coefficients of respective terms are as shown in a bottom column in FIG. 13.

Figure 15:
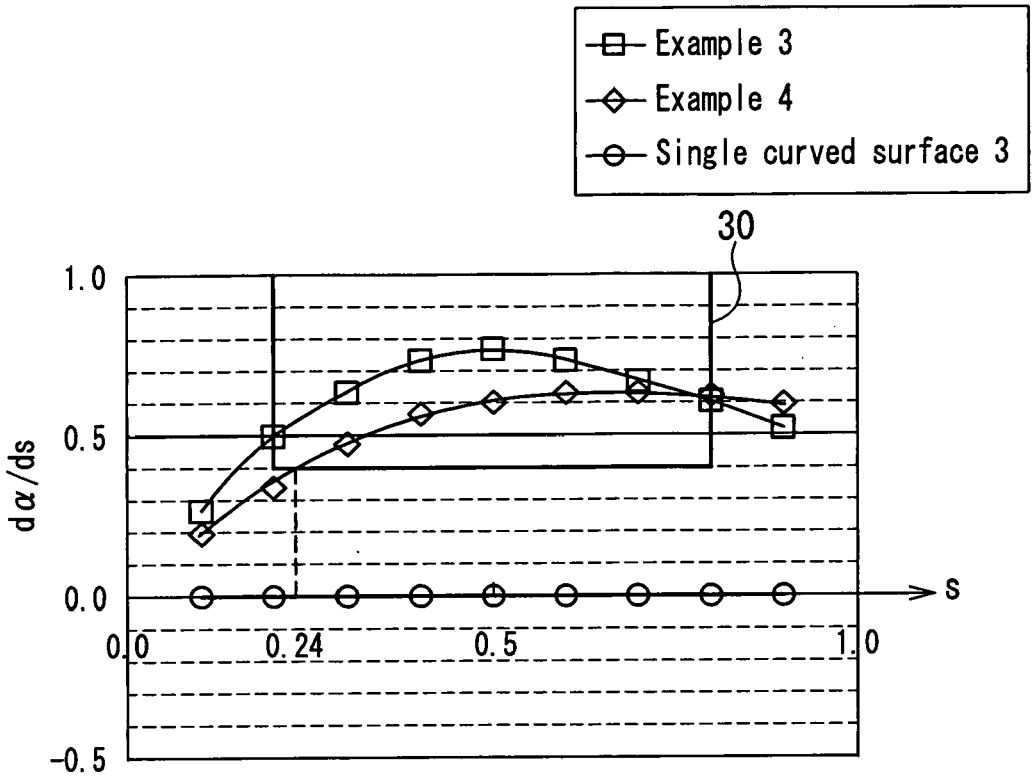
FIG. 15 shows change curves of $d\alpha(s)/ds$ regarding a shadow mask with a diagonal size of 60 cm.

FIG. 15 shows change curves of $d\alpha(s)/ds$ with respect to s in Example 3 and a single curved surface 3 in the same way as in FIG. 9. The "single curved surface 3" refers to a shadow mask having a perforated region in a spherical shape with a radius of curvature of 2209 mm in which the sagging amount $Z_{12}$ at the diagonal axis end (x=225 mm, y=169 mm) is set to be the same ($Z_{12}$=18.0 mm) as that of Example 3. In Example 3 according to the present invention, $d\alpha(s)/ds \geqq 0.4$ is satisfied in the entire range of $0.2 \leqq s \leqq 0.8$. More specifically, in the entire range of $0.2 \leqq s \leqq 0.8$, the change curve of $d\alpha(s)/ds$ passes through the region 30. Furthermore, a maximum value of $d\alpha(s)/ds$ is present in the range of $0.2 \leqq s \leqq 0.8$. In contrast, in the single curved surface 3, $d\alpha(s)/ds=0$ is satisfied over the entire surface of the perforated region 41 irrespective of the value of s, and the change curve of $d\alpha(s)/ds$ does not pass through the region 30.

When the shadow mask in Example 3 is applied to a panel having a flat outer surface, a color picture tube having excellent visibility can be realized. Furthermore, the shadow mask is made of a material containing 95% or more of iron, so that the formability thereof is satisfactory and the cost thereof is low.

Table 2 shows the movement amount of electron beams due to doming at an intermediate position (intermediate position on the major axis) between the screen center and the X-axis end of the screen, when the display as shown in FIG. 4 is performed, in the respective color picture tubes having the shadow masks of Example 3 and the single curved surface 3. As is understood from Table 2, in Example 3, the movement amount of electron beams is reduced to 57% of that of the single curved surface 3.

Figure 14:
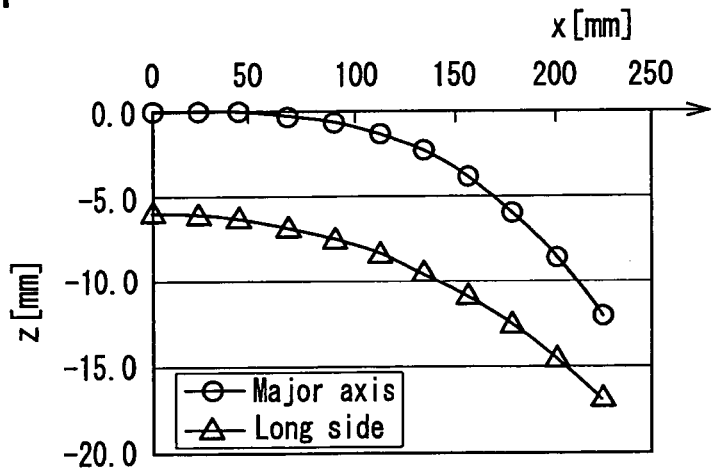
FIG. 14 shows sagging amounts along an X-axis and a long side of a perforated region of a shadow mask according to Example 4 of the present invention.

According to the present invention, the sagging amount $Z_{12}$ at the diagonal axis end of the shadow mask also can be reduced while the mislanding of electron beams due to doming of the shadow mask is suppressed. FIG. 14 shows sagging amounts along the X-axis and the long side 41*a* of the perforated region 41 of the shadow mask in Example 4, which is used for a color picture tube with the same size as that of Example 3 and in which the diagonal axis average radius of curvature is larger than that of Example 3, i.e., the sagging amount $Z_{12}$ at the diagonal axis end is reduced. The shadow mask in Example 4 is made of aluminum killed steel shown in Table 1 made of high-purity iron with a coefficient of thermal expansion of $12\times10^{-6}$ at 0° C. to 100° C. The sagging amounts along the X-axis and the long side 41*a* of the perforated region 41 can be approximated by a sixth degree polynomial of an X-coordinate value x, and coefficients of respective terms are as shown in a bottom column in FIG. 14.

FIG. 15 shows a change curve of $d\alpha(s)/ds$ with respect to s in Example 4 in the same way as in FIG. 9. In Example 4 according to the present invention, $d\alpha(s)/ds \geqq 0.4$ is satisfied in a range of $0.24 \leqq s \leqq 0.8$. More specifically, in a portion of 93% (=[(0.8×0.24)/(0.8×0.2)]×100) in the range of $0.2 \leqq s \leqq 0.8$, the change curve of $d\alpha(s)/ds$ passes through the region 30.

Even when the shadow mask in Example 4 is applied to a panel having a flat outer surface, a color picture tube having excellent visibility can be realized. Furthermore, the shadow mask is made of a material containing 95% or more of iron, so that the formability thereof is satisfactory and the cost thereof is low.

Table 2 shows the movement amount of electron beams due to doming at an intermediate position (intermediate position on the major axis) between the screen center and the X-axis end of the screen, when the display as shown in FIG. 4 is performed, in the color picture tube having the shadow mask in Example 4.

As is understood from Table 2, in Example 4, the movement amount of electron beams is reduced to 88% of that of the single curved surface 3. As in Example 4, the radius of curvature of the inner surface of the useful portion of the panel can be increased by decreasing the sagging amount $Z_{12}$ at the diagonal axis end, so that the thickness of the panel decreases, which makes it possible to reduce the weight of the panel. Thus, according to Example 4, the reduction in a panel weight, the enhancement of visibility, and the reduction in a mislanding amount of electron beams due to doming can be realized simultaneously.

In the present invention, it is preferable that the maximum value of $d\alpha(s)/ds$ is present in the range of $0.2 \leqq s \leqq 0.8$ because it is advantageous for the reduction in the movement amount of electron beams due to doming.

Furthermore, in the present invention, the shadow mask may be coated with bismuth oxide for the purpose of suppressing doming. This can further reduce the mislanding amount of electron beams due to doming.

The color picture tube according to the present invention has excellent visibility owing to a substantially flat panel outer surface, and can reduce color displacement caused by doming even when a shadow mask made of an iron material is used for the purpose of reducing cost. Therefore, the color picture tube according to the present invention can be used widely as one capable of performing a satisfactory color display.

The embodiments as described above are all intended to clarify the technical contents of the present invention. The present invention can be modified variously in the scope of the spirit of the present invention and claims without being limited to only such specific examples, and should be interpreted widely.

What is claimed is:

1. A color picture tube comprising a panel in which a phosphor screen is formed on an inner surface of a substantially rectangular useful portion, and a shadow mask, wherein the shadow mask includes a perforated region opposed to the phosphor screen and made of a substantially rectangular curved surface in which a number of electron beam passage apertures are formed, a non-perforated region placed on a periphery of the perforated region so as to surround the perforated region, and a skirt portion connected to the non-perforated region and bent with respect to the non-perforated region, wherein a radius of curvature of an outer surface of the useful portion of the panel is 10,000 mm or more, assuming that a tube axis of the color picture tube is a Z-axis, an axis orthogonal to the Z-axis and parallel to a long edge direction of the perforated region is an X-axis, an axis orthogonal to the Z-axis and parallel to a short edge direction of the perforated region is a Y-axis, a size of the perforated region on the X-axis is 2L, and s is a variable satisfying $0<s<1$, assuming that sagging amounts of the curved surface of the perforated region along the Z axis, with respect to a mask center, at points of X=0, sL, L on the X-axis, are $Z_{00}$, $Z_{01}(s)$, $Z_{02}$ respectively, and sagging amounts of the curved surface of the perforated region along the Z axis, with respect to the mask center, at points of X=0, sL, L on the long edge of the perforated region, are $Z_{10}$, $Z_{11}(s)$, $Z_{12}$ respectively, when, using a sagging amount difference $\Delta Z_{Z01}(s)$ at the point of X=sL with respect to the point of X=0 on the X-axis, defined by $\Delta Z_{01}(s)=Z_{01}(s)-Z_{00}$, a sagging amount difference $\Delta Z_{02}(s)$ at the point of X=L with respect to the point of X=sL on the X-axis, defined by $\Delta Z_{02}(s)=Z_{02}-Z_{01}(s)$ a sagging amount difference $\Delta Z_{11}(s)$ at the point of X=sL with respect to the point of X=0 on the long edge, defined by $\Delta Z_{11}(s)=Z_{11}(s)-Z_{10}$, and a sagging amount difference $\Delta Z_{12}(s)$ at the point of X=L with respect to the point of X=sL on the long edge, defined by $\Delta Z_{12}(s)=Z_{12}-Z_{11}(s)$, $\alpha(s)$ represented by $\alpha(s)=(\Delta Z_{01}(s)/\Delta Z_{11}(s))/(\Delta Z_{02}(s)/\Delta Z_{12}(s))$ is defined, $d\alpha(s)/ds \geqq 0.4$ is satisfied in at least a part of a range of $0.2 \leqq s \leqq 0.8$.

2. The color picture tube according to claim 1, wherein $d\alpha(s)/ds \geqq 0.4$ is satisfied in a portion of 50% or more in the range of $0.2 \leqq s \leqq 0.8$.

3. The color picture tube according to claim 1, wherein a maximum value of $d\alpha(s)/ds$ is in the range of $0.2 \leqq s \leqq 0.8$.

4. The color picture tube according to claim 1, wherein the shadow mask is made of a material containing 95% or more of iron.

* * * * *